United States Patent [19]

Nagashima

[11] 4,355,885

[45] Oct. 26, 1982

[54] IMAGE FORMING APPARATUS PROVIDED WITH SURFACE POTENTIAL CONTROL DEVICE

[75] Inventor: Nao Nagashima, Tokyo, Japan

[73] Assignee: Canon Kabushiki Kaisha, Tokyo, Japan

[21] Appl. No.: 151,676

[22] Filed: May 20, 1980

[30] Foreign Application Priority Data

May 29, 1979 [JP] Japan ..... 54-67162

[51] Int. Cl.[3] ..... G03G 15/00

[52] U.S. Cl. ..... 355/14 CH; 324/457; 355/3 CH; 361/235

[58] Field of Search ..... 355/3 R, 3 CH, 14 R, 355/14 CH; 324/452, 455, 457; 361/229, 235

[56] References Cited

U.S. PATENT DOCUMENTS 4,019,102 4/1977 Wallot ..... 355/14 CH X 4,136,942 1/1979 Nakahata et al. ..... 355/3 CH 4,166,690 9/1979 Bacon et al. ..... 355/3 CH

*Primary Examiner*—Fred L. Braun

*Attorney, Agent, or Firm*—Fitzpatrick, Cella, Harper & Scinto

[57] ABSTRACT

Image forming apparatus having a surface potential control device incorporated therein, in which magnitude of a measured value of the surface potential sensor and an aimed potential value is discriminated, and an output from an output device such as an exposure device that affects the image formation is increased or decreased for a predetermined value by the discriminated output, and in which the measuring, discriminating, adding and subtracting operations are repeated to control the surface potential within a predetermined range in a definite number of times for the measurement by decreasing the adding and subtracting quantities with increase in the number of times for the repeated operations.

12 Claims, 10 Drawing Figures

COMPUTER OUTPUT VS HV PRIMARY & SECONDARY TRANSFORMERS OUTPUT

IMAGE FORMING APPARATUS PROVIDED WITH SURFACE POTENTIAL CONTROL DEVICE

BACKGROUND OF THE INVENTION

This invention relates to an image forming apparatus utilizing the electrophotographic process. More particularly, the invention is concerned with an image forming apparatus provided with a surface potential control deivce which stabilizes the surface potential of a latent image formed on an image bearing member by an output from a measuring means.

The applicant of the present invention has previously proposed a method of controlling the surface potentials at light and dark portions of the image bearing member such as a photosensitive drum by first measuring the potential at these light and dark portions, then operating the measured values with coefficients, and varying an output from a charger based on the result of the operation (vide: U.S. patent application Ser. No. 68,416 filed Aug. 21, 1979). This surface potential control, however, is unavoidably complicated in its operations owing to use of coefficients. Moreover, the coefficients themselves cannot be said to be always accurate because of variations with lapse of time in the characteristics of the image bearing member, fluctuations thereof, variations with lapse of time in the outputs from the charger, and so forth.

SUMMARY OF THE INVENTION

It is an object of the present invention to provide an image forming apparatus having a surface potential control device, and which has solved the defects as mentioned above.

It is another object of the present invention to provide an image forming apparatus provided with a surface potential control device, in which magnitude of a measured value of the surface potential measuring means and an aimed potential value is discriminated, and an output from output means such as charging means, exposure means, etc. which gives influence on the image formation is increased or decreased for a predetermined value by the discriminated output.

It is still another object of the present invention to provide an image forming apparatus provided with a surface potential control device, which repeats the measuring, discriminating, adding and subtracting operations, and controls the surface potential within a predetermined range in a definite number of times for the measurement by decreasing the adding and subtracting quantity with increase in the number of times for the repeated operations.

It is yet another object of the present invention to provide an image forming apparatus having a surface potential control device, which is easy in programming the computer for the surface potential control, when it is used.

BRIEF DESCRIPTION OF THE DRAWINGS

The foregoing and other objects as well as the specific construction and operations of the image forming apparatus according to the present invention will become more apparent from the following detailed description thereof, when read in conjunction with the accompanying drawing, in which:

FIGS. 5A, 5B-1 and 5B-2 are program flow charts showing the program sequences stored in the ROM of a one-chip microcomputer Q1.

DETAILED DESCRIPTION OF PREFERRED EMBODIMENT

Figure 1:
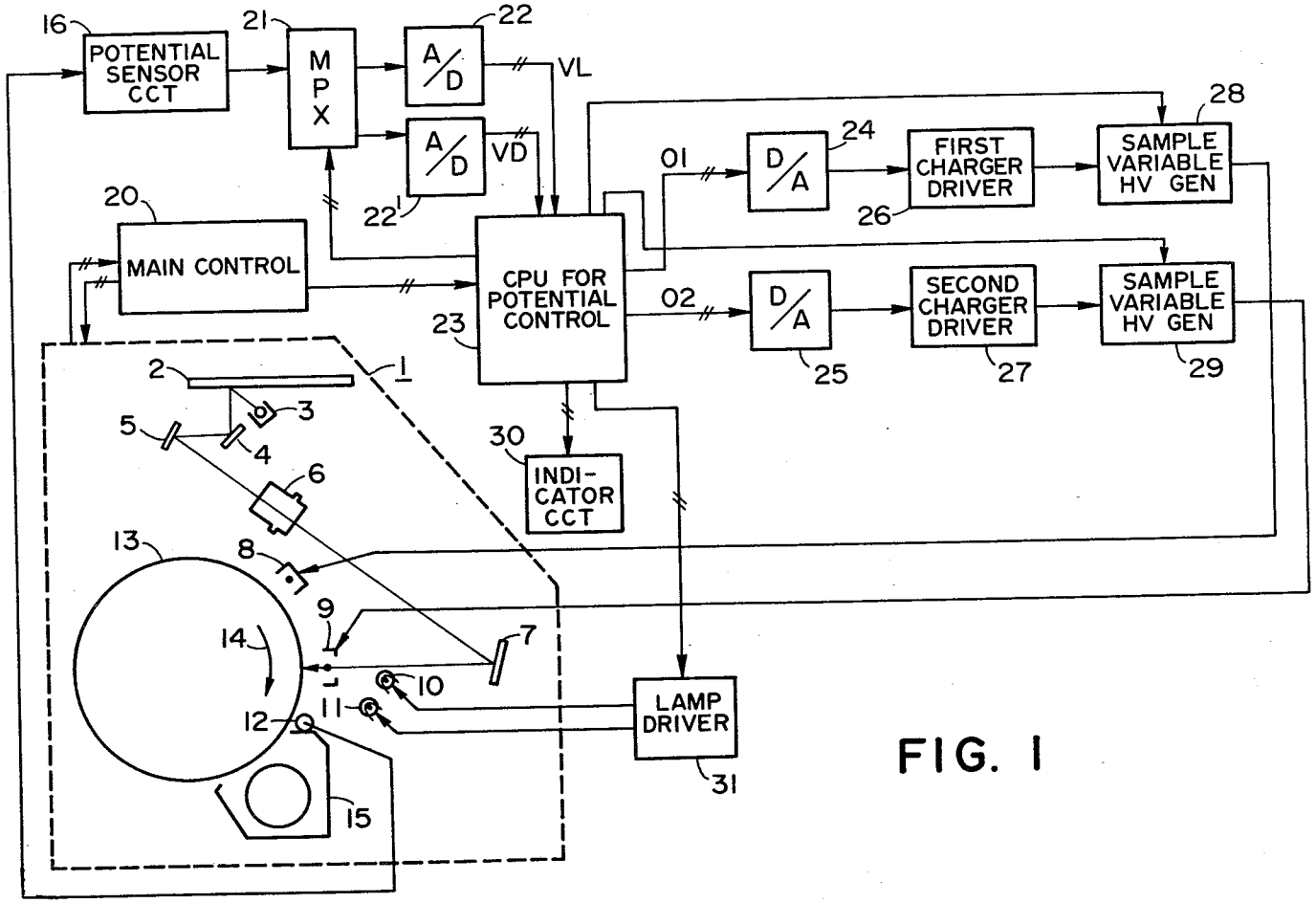
FIG. 1 is a schematic block diagram showing the control of a reproduction apparatus, to which the present invention is applicable.

In the following, the present invention will be explained in detail in reference to FIG. 1 of the drawing which shows one preferred embodiment of the present invention.

In the drawing, a numeral 1 refers to a main body of a reproduction apparatus; 3 refers to an original image exposure lamp; 4, 5, and 7 designate mirrors; 6 a lens system; 8 a primary charger; 9 a secondary charger; 10 a blank exposure lamp which prevents other region on the image bearing member then the image region from being developed; 11 an overall exposure lamp; 13 a photosensitive drum consisting of three layers of an insulating layer, a photoconductive layer, and an electrically conductive layer in the order from its surface, the drum being rotated in the direction of an arrow 14; 12 refers to a surface potentiometer to detect a surface potential on the photosensitive drum 13 (the potentiometer as disclosed, for example, in U.S. patent application Ser. No. 969,886 filed Dec. 15, 1978, now abandoned, may be used); and 15 refers to a developing device. The main body of the reproduction apparatus 1 is operated by the process steps as described in U.S. Pat. Nos. 4,071,361 or 3,666,363, for example.

A reference numeral 20 designates a main control for the apparatus main body; a numeral 21 refers to an analog multiplexer; 22 and 22' A/D converters (22 being A/D converter for the light portion potential, and 22' being A/D converter for the dark portion potential); 23 a microcomputer for the potential control (hereinafter abbreviated as "potential control CPU"0; 24 and 25 D/A converters; 26 a primary or first charger driver circuit which amplifies an output from the D/A converter 24; 27 a secondary or second charger driver circuit to amplify an output from the D/A converter 25; 28 and 29 variable high voltage generators for the primary and secondary chargers, respectively; 30 a display or indicator circuit; and 31 a lamp driver circuit.

According to this embodiment, the potential at both light and dark portions on the image bearing member is measured by the surface potentiometer 12 with the potential at a portion on the photosensitive drum 14, which has been irradiated with light from the blank exposure lamp 10, being the light portion potential, and with the potential at a portion of the photosensitive drum 14, which has not been irradiated with the light from the blank exposure lamp 10, being the dark portion potential.

Generally, the dark portion potential monotonously increases when the output from the primary charger increases, while the light portion potential monotonously decreases when the output from the secondary charger increases. However, variations in the output from the primary charger affect the light portion potential, and the variations in the output of the secondary charger affect the dark portion potential.

In FIG. 1, the light portion potential and the dark portion potential which have been detected by the surface potentiometer 12 are rendered into digital signals by the A/D converter 22 through the potential sensor circuit 16 and the multiplexer 21. The digital value of the light portion potential is represented by a symbol VL, and the digital value of the dark portion potential is denoted by a symbol VD. Further, the digital outputs to the D/A converters 24, 25 are respectively represented by "01" and "02".

Figure 2:
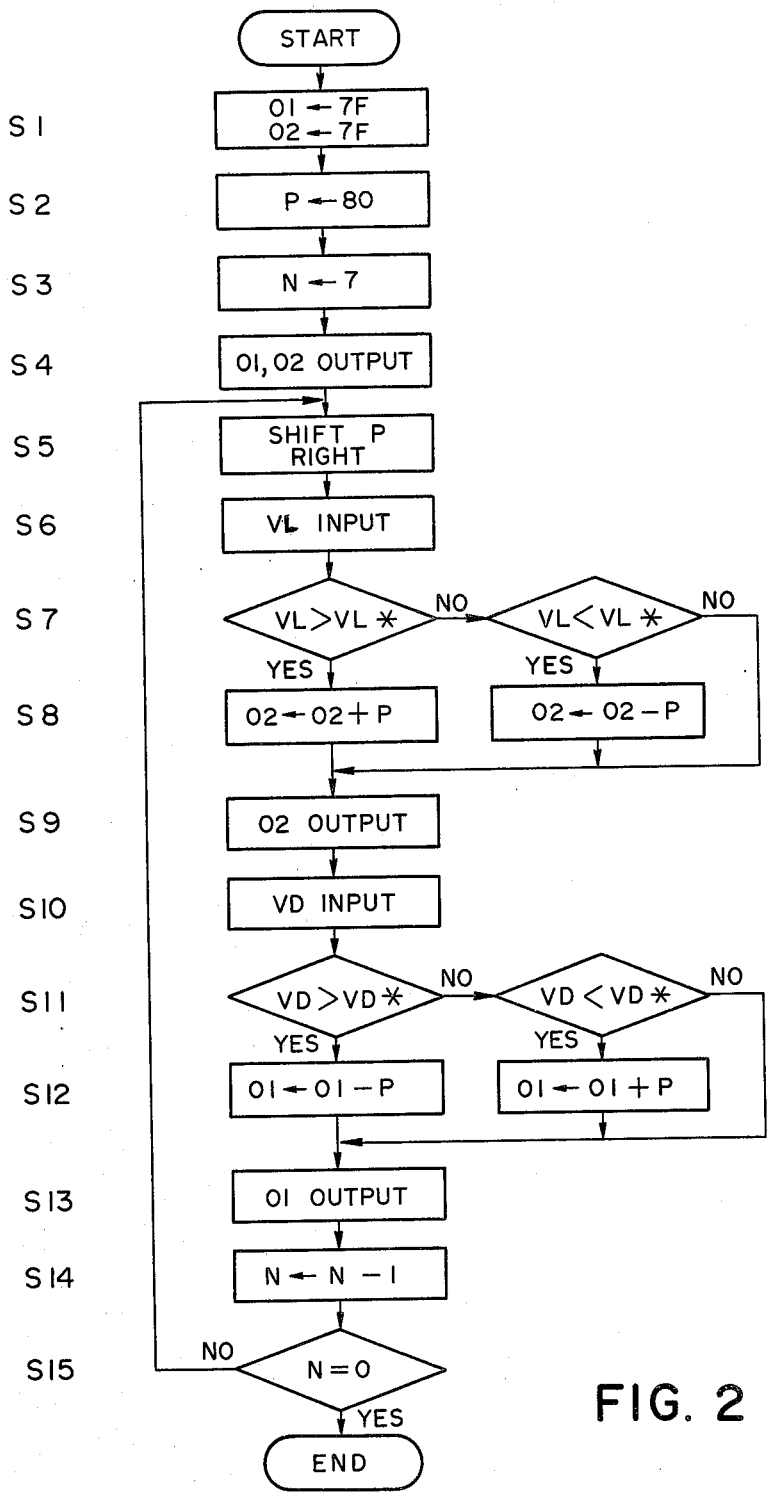
FIG. 2 is a control flow chart for the apparatus shown in FIG. 1.

FIG. 2 is a process flow chart of the potential control CPU 23. It should be noted here that the actual relationship between the surface potential on the photosensitive drum 13 and the digital values VL, VD is such that, when the surface potential increases, the digital values VL and VD increase accordingly. It should further be noted that, with increase in the digital outputs 01 and 02, the output values from the variable high voltage generators 28, 29 also increase. Incidentally, the digital values VL, VD, 01, and 02 are all 8-bit signals, which will hereinafter be indicated sexadecimally in two digit value for 4 bits each.

The control flow will be explained hereinbelow in reference to FIG. 2 starting from the step S1 to the step S15.

STEP S1

First of all, the initial value for the digital output values 01 and 02 is set at "7F". While this initial value may be any one selected from "00" to "FF", if it is so set that a reference value for the output from the primary and secondary chargers may become an intermediate value of "00"-"FF", the convergence to the aimed value due to the control becomes quick.

STEP 2

Next, "80" is set in a location P of RAM (not shown) in the CPU 23 as a parameter for adding and subtracting the digital output values 01 and 02.

STEP S3

Also, "7" is set in a predetermined location N of RAM. This numeral "7" denotes a number of times for the control of the output values 01 and 02.

STEP 4

The number "7F" which has been set at the step S1 for the output values 01 and 02 is forwarded as an output to the D/A converters 24, 25.

STEP S5

The address P which has been set at the step S2 is shifted to the right. Since the address P is set at "80", it can be represented by a binary code as follows.

| |
|---|
| 1 0 0 0 0 0 0 0 |
| ↓ |
| 0 1 0 0 0 0 0 0 |

STEP 6

The light portion potential is measured, and the digital value VL is stored in the CPU 23. The light portion potential is the potential at a portion where light irradiation has been done by the blank exposure lamp 10, which is detected by the potentiometer 12. When the detected value is of the light portion potential, the potential control CPU 23 to be controlled by the main control 20 controls the multiplexer 21 which selects A/D converters 22 and 22' for the light portion potential and the dark portion potential. When the light portion potential is measured, the A/D converter 22 is selected.

STEPS S7 and S8

Since the light portion potential is greatly affected by the secondary charger output, the output value 02 is controlled with the digital value VL. The digital value VL for the light portion is then compared with the aimed value VL* for the control. When VL>VL*, the control [02+P→02] is performed, and when VL<VL*, the control [02−P→02] is performed. No change is made to the output value 02 when VL=VL*.

STEP 9

The output value 02 which has been changed at the steps S7 and S8 is produced as an output.

STEP 10

Subsequently, the dark portion potential is measured, and the digital value VD is stored in the CPU 23. The dark portion potential is the potential of a portion where no light irradiation has been done by the blank exposure lamp 10, which is detected by the potentiometer 12. When the detected value is of the dark portion potential, the potential control CPU to be controlled by the main control 20 controls the multiplexer 21 which selects the A/D converter 22' for the dark portion potential.

STEPS S11 AND S12

Since the dark portion potential is greatly affected by the primary charger output, the output value 01 is controlled with the digital value VD. The digital value VD is compared with the aimed value VD* for the control. When VD>VD*, the control [01−P→01] is performed, and when VD<VD*, the control [01+P→01] is performed, thereby changing the output value 01. No change is made to the output value 01 when VD=VD*.

STEP 13

The output value 01 which as been changed at the steps S11 and S12 is produced as an output.

STEPS S14 AND S15

The steps S5 to S13 are repeated until the control number of times N becomes zero with N being −1. In this instance, the address P is shifted to the right at the step S5. In other words, the value of P changes as follows in the form of the binary code.

| | |
|---|---|
| When N = 7 | 0 1 0 0 0 0 0 0 |

-continued

| | |
|---|---|
| N = 6 | 0 0 1 0 ↓ 0 0 0 0 |
| N = 5 | 0 0 0 1 ↓ 0 0 0 0 |
| N = 4 | 0 0 0 0 ↓ 1 0 0 0 |
| N = 3 | 0 0 0 0 ↓ 0 1 0 0 |
| N = 2 | 0 0 0 0 ↓ 0 0 1 0 |
| N = 1 | 0 0 0 0 ↓ 0 0 0 1 |

Therefore, by the abovementioned operations, the output values 01 and 02 can be spaced at an interval of 1 bit between the "00" and "FF" so as to add and subtract this address P to and from the output values 01 and 02.

Figure 3:
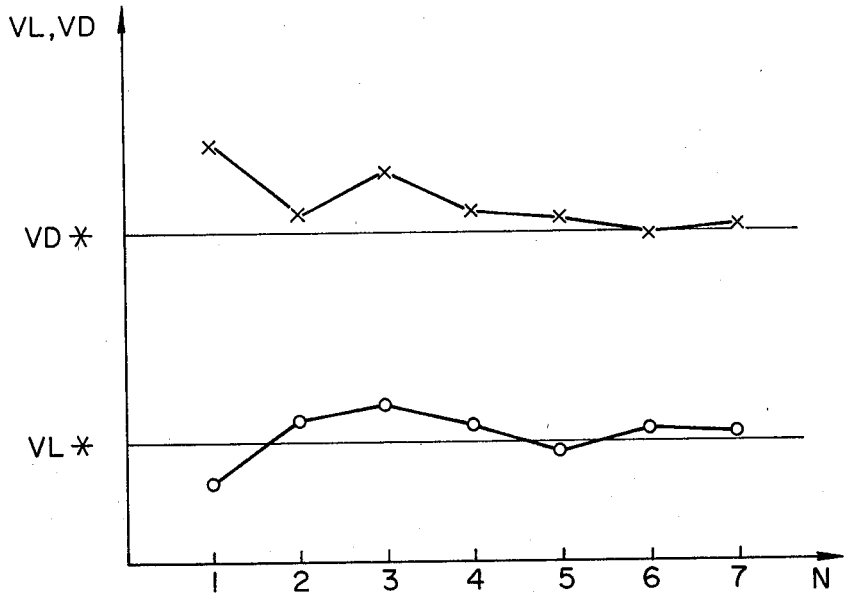
FIG. 3 is a graphical representation showing measured values in experiments utilizing the apparatus according to the present invention.

The characteristic point in the above-described potential control is that, in spite of the quantity to be varied by measuring the digital value VL being the output value 02 alone, an influence on the variation in the output value 02 is introduced into the digital value VD to be subsequently measured, whereby convergence can be attained properly. It goes without saying that the influence of the digital value VL to the variation in the output value 01 is also introduced. Moreover, since the operations required for the control are "shifting", "comparing", "adding", and "subtracting", there accrue further advantages such that the computer programming becomes very simple, the output value can be controlled to one close to the aimed value, and so forth. FIG. 3 is a graphical representation of measured values in the experiments utilizing the device according to the present invention. The value P may be taken individually by dividing it as P1, P2 with respect to each of the output values 01, 02. Also, the number of times N may be less than seven. When the value of N is small, the variable range of the output value 01 or 02 becomes small. After the control in FIG. 2 has been effected, the values 01 and 02 become the output of definite values. However, since there is a possibility of the digital values VL and VD being changed depending on changes in the circumstances, moe perfect control method would be such that this converged value is made the initial value, the control number of times N is made a few times, the parameter P is made "20", "10", "08", etc. in conformity to the control number of times N, thereby repeating the control operations prior to the copying operation or at every definite time.

Furthermore, in the course of repeating such control operations, there occurs an occassion wherein the output values 01, 02 exceed the values of "00" and "FF" as the result of the operations. This situation indicates that the output values have exceeded the variable ranges of the primary and secondary outputs to have become an incontrollable state. Accordingly, at the time of adding or subtracting the parameter P to or from the output values 01 and 02, if a discrimination is done by a program as to whether the values have become below "00" or above "FF" and the result of the discrimination is indicated by the display circuit 15, it becomes possible to indicate an abnormal state.

Also, by dividing the primary and secondary outputs through resistors, etc. and connecting the divided outputs to the A/D converter of the microcomputer, it is possible to observe whether the output is produced regularly, or not. Whether the primary and secondary outputs are within outputs of an error as established with respect to the output values 01 and 02 produced by the abovementioned control, or not can be readily judged by the computer program. If abnormality exists in the finding, a display to this effect is done by using the display circuit 15, whereby the abnormal state can be indicated.

The foregoing explanations are with respect to a case wherein the 8-bit A/D converter, microcomputer, and D/A converter are used. According to the method, when the device has an n-bit construction, the control is also possible with a 1-bit resolution, wherein the digital values VL and VD are measured for the maximum n−1 times to effect the operations of the output values 01 and 02. Moreover, according to the present embodiment, the digital value VD is measured after measurement of the digital value VL, although the value VD may be measured first. Therefore, the present invention does in no way limit the sequence of measurement in the digital values VL and VD.

Figure 4:
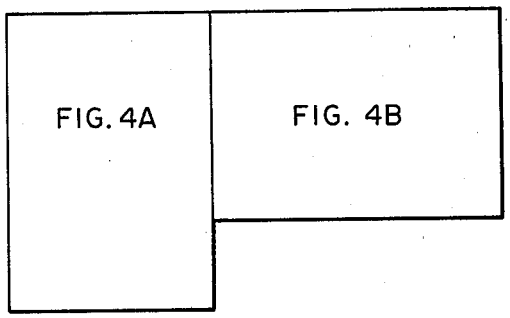
FIG. 4 is a block diagram of the combined control circuit.
Figure 4A:
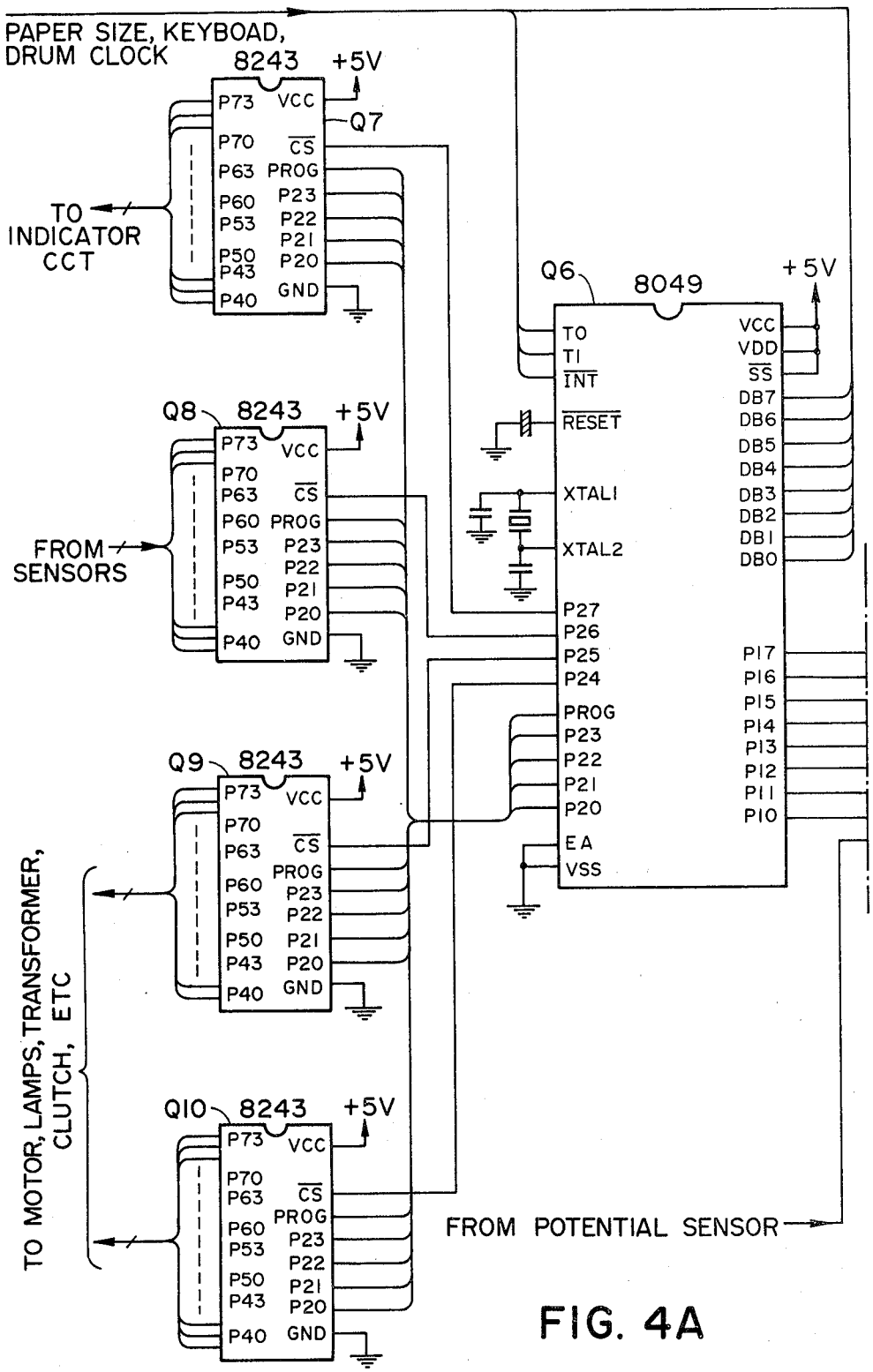
FIGS. 4A and 4B, when combined as shown in FIG. 4, are detailed diagrams of the control circuit.
Figure 4B:
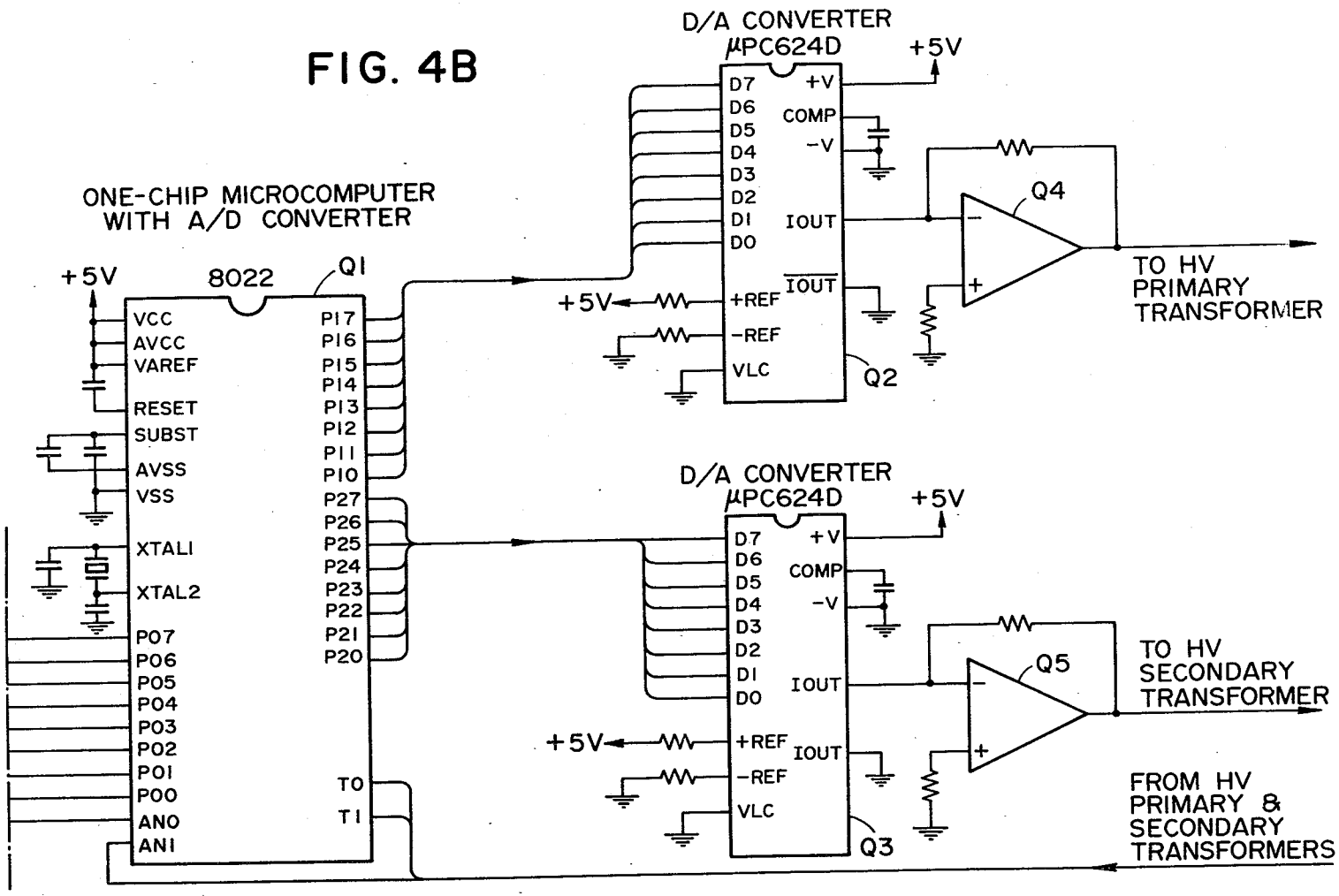

In the following, explanations will be given in reference to FIG. 4 as to the actual construction of the control circuit for such embodiment. In the drawing, Q1 refers to an 8-bit one-chip microcomputer INTEL 8022 with an A/D converter being incorporated therein. The computer Q1 has therein 8-bit A/D converter (two input channels), a ROM of 2k bytes, and RAM of 64 bytes. It receives a control timing signal from a computer Q6 (INTEL 8049), and executes a predetermined process. The computer Q6 (INTEL 8049) is an 8-bit one-chip microcomputer having therein a ROM of 2 K bytes and RAM of 128 bytes, which controls operations of the apparatus main body. To the computer Q6, there are further connected computers Q7 to Q10 (INTEL 8243), input and output expanders to effect input control of a display circuit, various sensors, motor, and so forth.

To an analog input ANO of the computer Q1, there is connected a measuring signal from a potential sensor. The computer Q1 performs A/D-conversion of the measuring signal, and introduces thereinto a measured potential input as the digital value. Further, it performs the operations on the basis of the measured potential input, and sends out an output control signal to the D/A converter. The D/A converter of the computers Q2 and Q3 is an 8-bit D/A converter μPC 624D (produced by Nippon Electric Co., Ltd. Japan). The digital signal from the computer Q1 is converted to an analog signal in the computers Q2 and Q3, and the thus obtained analog signal controls outputs from a high tension primary and secondary transformers through an amplifier constructed with Q4 and Q5.

Figure 5A:
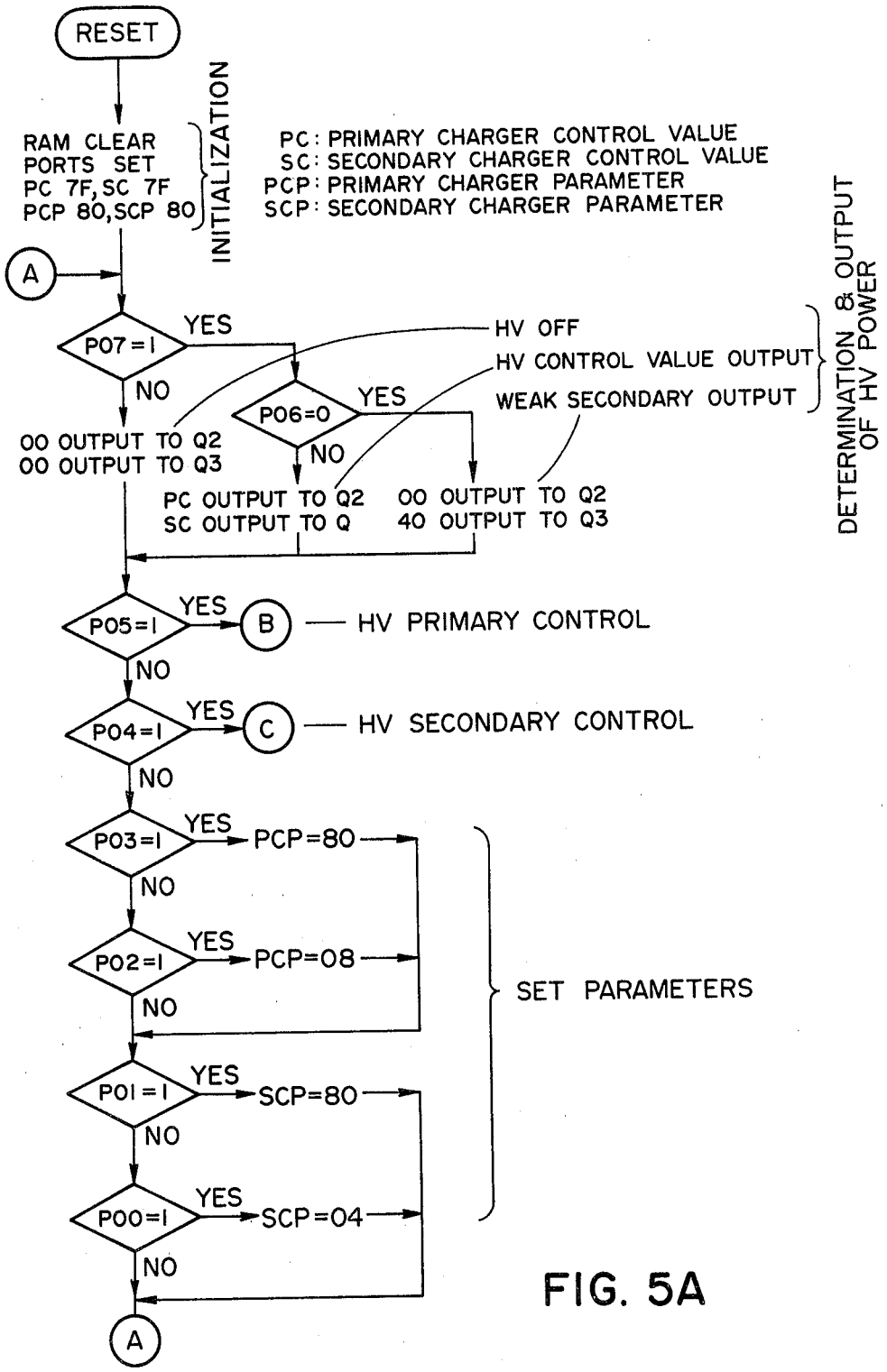
Figures 1, 5B:
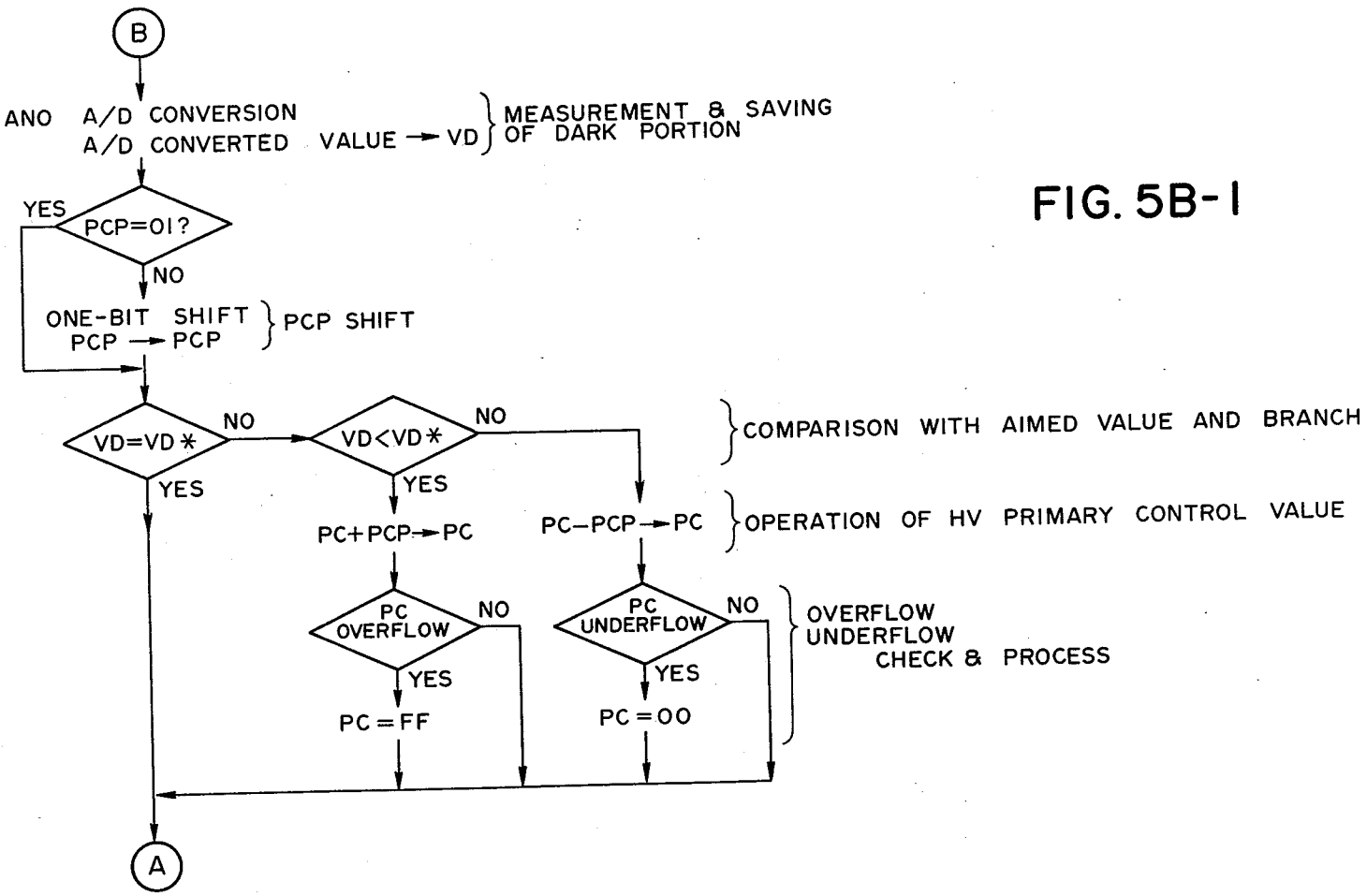
Figures 2, 5B:
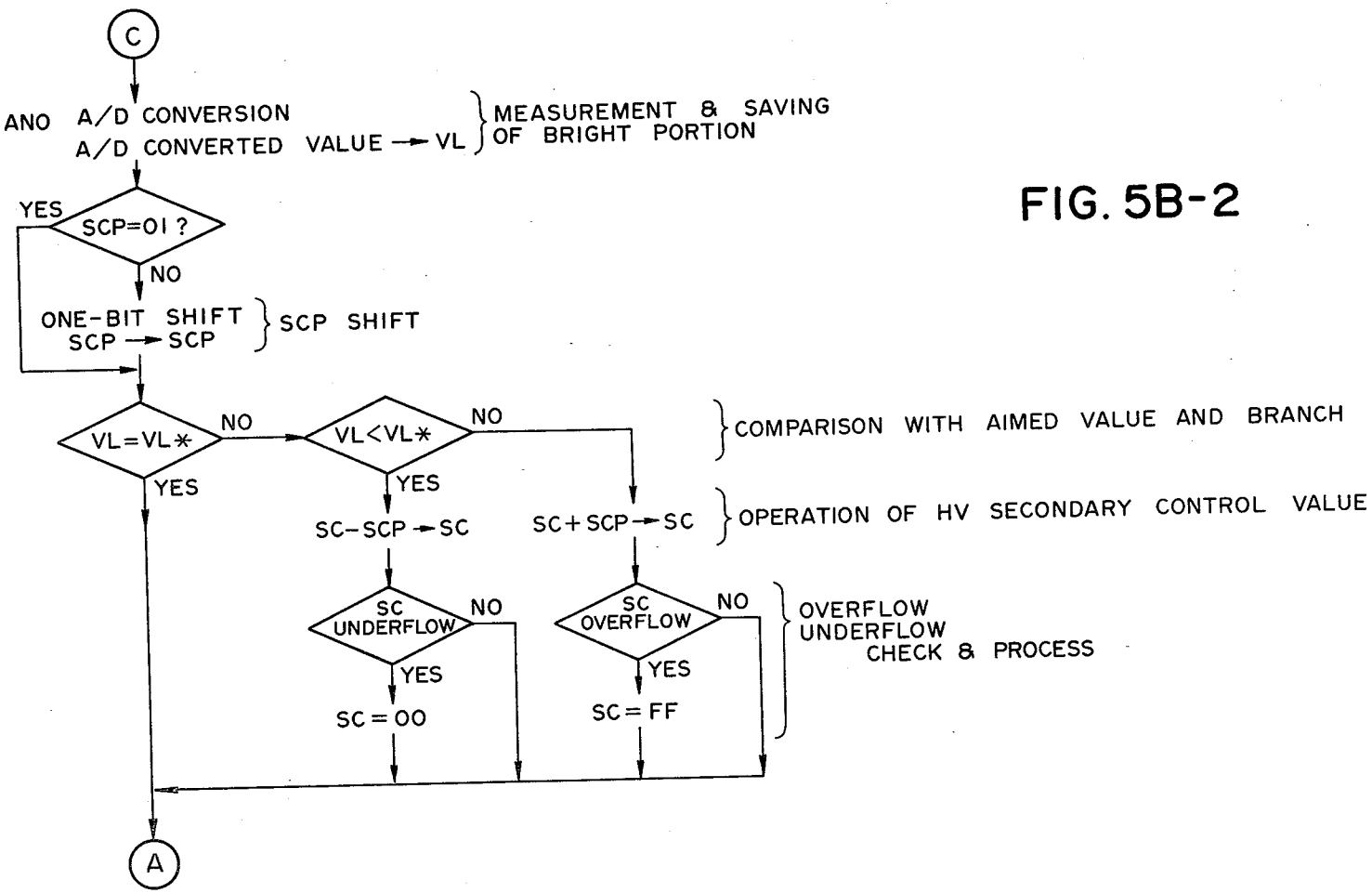

FIGS. 5A and 5B show the program flow charts stored in the ROM of such microcomputer Q1. In the flow charts, PC refers to an output value of the computer Q1 for controlling the primary charger, SC refers to an output value of the computer Q1 for controlling the secondary charger, PCP designates a parameter for controlling the primary charger, and SCP denotes a parameter for controlling the secondary charger. Further, P00 to P07 correspond to the terminals of the computer Q1. Input signals to operate the device are introduced into the computer Q6 for controlling the main body in the manner as shown in the table below.

| Signal Terminals | Contents (when each terminal is 1) |
|---|---|
| P00 | SCP = 08 |
| P01 | SCP = 80 |
| P02 | PCP = 08 |
| P03 | PCP = 80 |
| P04 | high tension primary transformer control |
| P05 | high tension secondary transformer control |
| P06 | high tension primary transformer "on" |
| P07 | high tension secondary transformer "off" |

As seen from the above table, since the computer for the main body control is able to change the initial set values of PCP and SCP, number of times for the control can also be changed in accordance with the conditions in the image forming device. That is to say, any one control number of times can be selected from a plurality of numbers of times for the control.

Unlike the block diagram in FIG. 1, the A/D converter is incorporated in the computer Q1 and discriminates the A/D-converted values VD and VL by timings. The detailed circuit constructions of the high tension primary transformer and the high tension secondary transformer are disclosed in the aforementioned pending U.S. patent application Ser. No. 68,416 filed Aug. 21, 1979.

Figure 6:
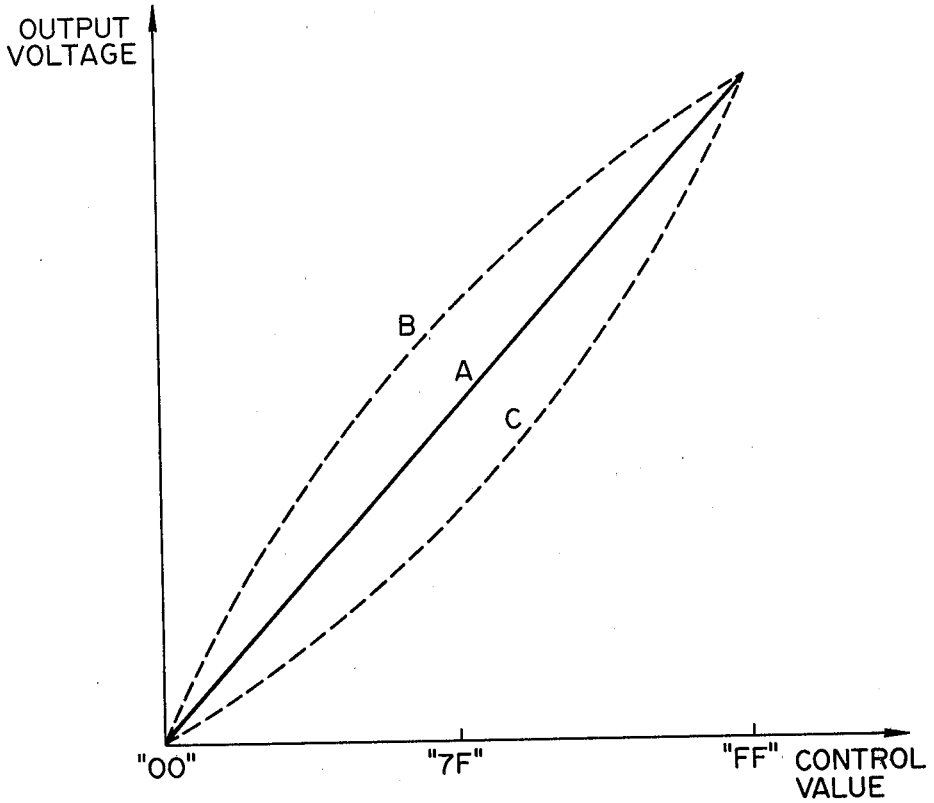
FIG. 6 is a graphical representation showing a relationship between control output values of the computer Q1 and output voltages of the primary and secondary high tension transformers.

FIG. 6 shows a relationship between the control output values PC and SC of the computer Q1 and the output voltages from the high tension primary and secondary transformers. According to the embodiment of the present invention, the relationship is represented by a straight line A, but it is not limited to the rectilinear line alone and any representation showing monotonous increase or decrease will be satisfactory. Furthermore, in the present embodiment, explanations have been given as to the output control of the charger alone. It should, however, be noted that the surface potential can be stabilized to a predetermined value by controlling the exposure light quantity of a device such as, for example, an exposure means which gives influence on the image formation in the same manner as that of controlling the output from the abovementioned charger.

As stated in the foregoing, since the present invention reduces the adding and subtracting quantity of the output to and from the charger along with increase in the number of times, for the control, highly precise control becomes possible. Further, since no coefficient is used, the device is not affected by any change with lapse of time in the characteristics of the charger or the image bearing member such as photosensitive member.

In this embodiment, too, explanations have been made as to the case wherein the photosensitive member of a three-layered structure is used. However, the invention is not limited to such layer structure, but is also applicable to the image forming apparatus using the photosensitive member of two-layered structure, or of a type which forms an electrostatic latent image on an insulative member.

What I claim is:

1. Image forming apparatus provided with a surface potential control device, comprising:

an image bearing member;

output means for use in forming a latent image on said image bearing member wherein said output means produces a variable output to control the surface potential of said image bearing member;

measuring means to measure the surface potential on said image bearing member; and means to discriminate the magnitude of an output from said measuring means with respect to a reference value, and for causing said reference value to vary by a predetermined value in accordance with a discriminated output, said predetermined value being gradually changed in accordance with the process of the discrimination operation, said discriminating means having an output coupled to said output means for controlling said variable output thereof.

2. Image forming apparatus as set forth in claim 1, wherein said discriminating means repeats the discrimination and the reference value variations for a plurality of times.

3. Image forming apparatus as set forth in claim 2, wherein the variation of said reference value is reduced with the increase in said plurality of times.

4. Image forming apparatus as set forth in claim 1, 2 or 3, wherein said output means is a charging means.

5. Image forming apparatus provided with a surface potential control device, comprising:

an image bearing member;

variable output means for use in forming a latent image on said image bearing member, wherein said output is capable of providing varying outputs which control the surface potential of said image bearing member;

measuring means to measure the surface potential on said image bearing member;

digital computing means for setting a digital output value to be supplied to said variable output means, and for discriminating magnitude of an output from said measuring means with respect to the digital output value, and for adding or subtracting a predetermined digital value to or from the digital output value set in response to the discrimination output, said predetermined digital value being changed in accordance with the process of the discriminating operation; and control means for controlling the output from said variable output means in accordance with the output from said digital computing means.

6. Image forming apparatus as set forth in claim 5, wherein the measurement by said measuring means, the discrimination by said digital computing means, and the control by said control means are repeated for a predetermined number of times, and said predetermined digital value decreases with the increase in the number of times of the repeated operations.

7. Image forming apparatus as set forth in claim 6, wherein said predetermined digital value consists of a plurality of bits, of which at least one is at a first signal level, and said first signal level portion shifts each time the number of times for the repeated operations increases.

8. Image forming apparatus as set forth in claim 5, wherein the initial value of said digital output value is substantially an intermediate value of the output from said variable output means.

9. Image forming apparatus as set forth in claim 5, 6, 7 or 8, wherein said variable output means is a charging means.

10. Image forming apparatus as set forth in claim 5 or 6, further comprising a digital computer, and wherein operation of said digital computing means is executed in accordance with control programs of said digital computer.

11. Image forming apparatus as set forth in claim 6, wherein the numerical value of said predetermined number of times is made selectable.

12. Image forming apparatus as set forth in claim 7, wherein said number of times for repeated operations is less than the number of bits of said output digital value.

* * * * *